United States Patent [19]

Spadini et al.

[11] 4,111,854

[45] Sep. 5, 1978

[54] GENERAL PURPOSE HOUSEHOLD CLEANER

[75] Inventors: Gianfranco Luigi Spadini, Strambeek-Bever, Belgium; Emiel Mathilde Anna Alfons Demessemaekers, Cincinnati, Ohio

[73] Assignee: The Procter & Gamble Company, Cincinnati, Ohio

[21] Appl. No.: 559,185

[22] Filed: Mar. 17, 1975

[30] Foreign Application Priority Data

Mar. 15, 1974 [FR] France ..... 74 08994

[51] Int. Cl.[2] ..... C11D 1/02; C11D 1/12; C11D 3/33

[52] U.S. Cl. ..... 252/541; 252/554; 252/556; 252/558; 252/DIG. 5

[58] Field of Search ..... 252/541, 108, 117, 121, 252/DIG. 14, DIG. 5; 424/171

[56] References Cited

U.S. PATENT DOCUMENTS

| | | | |
|---|---|---|---|
| 3,548,056 | 12/1970 | Eigen et al. | 424/171 |
| 3,869,399 | 3/1975 | Collins | 252/545 X |
| 3,898,186 | 8/1975 | Mermelstein et al. | 252/528 |

FOREIGN PATENT DOCUMENTS 877,909 8/1971 Canada.

*Primary Examiner*—Thomas J. Herbert, Jr.
*Attorney, Agent, or Firm*—Steven J. Goldstein; Robert B. Aylor; Richard C. Witte

[57] ABSTRACT

This invention relates to a general purpose household cleaner or cleaning composition in granular, powdered aggregated, agglomerated, pasty or liquid form, to be diluted in water, but which can be applied as such when in liquid form, effectively removing both organic- and inorganic-, acidic- and alkaline soil without requiring any additional rinsing step or steps and/or wiping, containing a specific organic, anionic surface-active detergent and a lower polypeptide having a molecular weight below 600, and an isoelectric point of at least 5.5, or mixtures of said polypeptides, or a protein hydrolysate containing mainly lower polypeptides, having an isoelectric point of at least 5.5, and a neutral carrier. More particularly, it relates to a general purpose household cleaning composition, preferably to an aqueous, liquid, homogeneous, clear, general purpose household cleaning composition for hard surfaces, substantially free of inorganic and/or organic builder salts, to be diluted in hard water, containing a specific organic, anionic, surface-active, detersive sulfuric acid reaction product, a lower polypeptide having a molecular weight below 600, preferably between 350 and 450, and an isoelectric point above 5.5 and mixtures thereof, or a protein hydrolysate consisting of at least 50% by weight of lower polypeptides having a molecular weight below 600, preferably between 350 and 450, and an isoelectric point of at least 5.5, and containing at most 15% by weight of organic amino acids and at most 25% by weight of penta- and higher polypeptides, and a neutral carrier, preferably water.

7 Claims, No Drawings

GENERAL PURPOSE HOUSEHOLD CLEANER

BACKGROUND OF THE INVENTION

General purpose household cleaning compositions for hard surfaces, including metal surfaces, glass, ceramic, and other non-metallic surfaces, hard and relatively durable organic surfaces such as paint, plastic, linoleum, are available in both powdered and liquid forms. The vast majority of said hard surface and general purpose household cleaning compositions mainly consist of materials other than organic surface-active detergents, with inorganic salts as phosphates, carbonates, silicates, forming their backbone. Said compositions generally exhibit wide variations in organic-, particularly grease, and inorganic soil removal, overall cleaning, soil suspension, grease and/or wax emulsification, shine, gloss, harshness, and foaming ability, leaving on cleaned surfaces lasting films, streaks and spots which are difficult to remove, and request frequent rinsing and wiping.

Solid, general purpose household cleaning compositions consist mainly of builder salts, and inorganic builders. These compositions result in filming, even damage to some metal surfaces such as brass and silver. The common liquid general purpose household cleaning compositions contain besides relatively high amount of builder salts, fairly high amounts of solvents and hydrotropes, which compounds do not provide any detersive benefit. Some specific hard surface cleaners contain in addition special ingredients either to protect the substrate or to remove specific soils. Corrosion inhibitors are, for example, included in metal-cleaning compositions (U.S. Pat. No. 2,485,554), peroxides are added to bleach out organic stains (U.S. Pat. No. 2,576,205), and even such special metal salts as zincates, beryllates or aluminates have been proposed (U.S. Pat. Nos. 2,575,576; 2,514,304 and 2,447,297). Other specific hard surface cleaners require a special acidic after-treatment, for example with acidic solutions of fluosilicates (U.S. Pat. No. 2,656,289). Thus, achieving equal efficiency in removing both inorganic and organic soils and, in particular, greasy soil with commonly available general purpose household cleaning compositions is hardly possible. Further, any improvement on inorganic soil removal of such household cleaning compositions results in a loss on organic soil and, particularly, on grease removal, and vice-versa, while the incorporation of organic and/or inorganic builder salts to sequester the water hardness ions and to enhance the cleaning efficiency of the surface-active detergent compound yields in addition an even more pronouncd filming, streaking and spotting due to the salt residues left on the cleaned hard surfaces, spoiling the gloss of the latter if not rinsed frequently.

It has now been found that the foregoing disadvantages of common, general purpose household cleaning compositions, both solid and liquid, can be overcome by the present invention. The cleaning compositions of this invention are particularly suitable for all kinds of hard surfaces and has outstanding organic soil and inorganic soil removal properties when diluted in hard water, does not leave films, streaks, stripes or spots, and does not require subsequent rinsing and/or wiping. The foregoing is accomplished by polypeptide, i.e., a di-, tri-, or tetrapeptide, and mixtures thereof, or a specific protein hydrolysate with a selected organic, surface-active, detersive sulfuric acid reaction product or a water-soluble salt thereof.

It is surprising that such performances can be achieved with a rather uncomplicated general purpose household cleaning composition, containing only two essential components: a specific organic, anionic, surface-active, detersive sulfuric acid reaction product, and an elected lower polypeptide and mixtures thereof or a protein hydrolysate, because of the absence of detergency-enhancing builder salts and because lower polypeptides are void of any detersive activity.

The presence in general purpose household cleaning compositions of water hardness complexing and detergency-enhancing organic and/or inorganic builder salts has always been considered absolutely necessary. The substantially builder-free cleaning composition of this invention, when diluted in hard water and even in very hard water (e.g. hardness expressed in millimoles of $CaCO_3$ per liter of 3.5 and higher), in concentrations as low as 0.5% by weight calculated on the finished product, shows excellent organic and inorganic removal performances, however, without leaving streaks, films or spots on the cleaned hard surfaces, rendering additional rinsing and/or wiping superfluous.

These performance results are the more surprising, because they are only obtained with a specific organic, anionic, surface-active, detersive sulfuric acid reaction product, chosen from the group consisting of paraffin sulfonic acid having from 12 to 22 carbon atoms; alkyl benzene sulfonic acid having from 8 to 18 carbon atoms in the alkyl radical; alkyl sulfuric acid esters having from 10 to 22 carbon atoms in the alkyl group; the corresponding alkali-metal, ammonium and substituted ammonium salts, and mixtures thereof.

Combinations of any other organic, anionic, detersive sulfuric acid reaction products as olefin sulfonic acid, ethoxylated alkyl sulfuric acid ester, alkyl glyceryl ether sulfonic acid, the corresponding alkali-metal, ammonium and substituted ammonium salts, or mixtures thereof, or nonionic, cationic, zwitterionic and ampholytic surface-active detergents with said lower polypeptides or protein hydrolysate do not yield same or similar results.

None of the combinations of any of said specific synthetic, organic, anionic, surface-active, detersive sulfuric acid reaction products, nor of any other organic, synthetic, anionic, surface-active, detersive sulfuric acid reaction product, as olefin sulfonic acid, etc., and/or nonionic, cationic, zwitterionic and ampholytic surface-active detergent combined with similar amounts (as the amounts of polypeptide or protein hydrolysate of the composition of the present invention) of either (a) organic and/or inorganic builder salts or (b) pure amino acids or (c) polypeptides having a higher molecular weight, is as effective in overall cleaning, organic-and inorganic soil removal, soil suspension and grease emulsification, non-filming, non-streaking and non-spotting as the claimed composition.

Higher aliphatic amines, and other N-containing compounds as alkyl ethanol amides, morpholides, nitrides, as well as lower acyl derivatives of higher fatty acids (U.S. Pat. Nos. 2,383,525 and 2,383,737), or amino acids and lower polypeptides, which are said to lower the surface tension of surface-active detergents (German Pat. No. 734,337), have been propsed as additives into textile detergent compositions. Also, proteins such as casein, glue, albumen, etc., which are said to be excellent protective colloids aiding in removing and segregating soil, have been proposed as textile detergent additives (Chemical Abstracts, 37, 2203). However, regardless of some similarities which exist between textiles washing and hard surface cleaning, there are fundamental differences between hard surface cleaning and textile washing, and consequently between the compositions. For example, the hard surface cleaning generally occurs with an implement, e.g. a sponge, containing a restricted amount of water. Thus, textile cleaning technology cannot be used as such in hard surface cleaning.

Liquid detergent compositions containing small amounts of partially degraded proteins, or protein hydrolysates containing polypeptides having an average molecular weight of at least 600, typically 600–12.000, as skin-protecting additives, are disclosed in British Patent specification No. 1,160,485 and in U.S. Pat. No. 3,548,056. The use of protein hydrolysates as skin-protecting agents or mildness improvers in detergent compositions is also disclosed in Canadian Pat. No. 877,909. The use of the elected lower polypeptides or protein hydrolysates of the composition of the present invention did not reveal any noticeable skin benefit either immediately or after extended use. Thus, the elected polypeptides or protein hydrolysates as used in the composition of the present invention must differ from those mentioned in said British American or Canadian patent specifications. They do differ because, as already said above, compositions contaiing applicant's specific water-soluble, organic, anionic, surface-active, detersive sulfuric acid reaction products and higher polypeptides, e.g. having an average molecular weight above 600, for example 800, 1200 and above, do not yield the same organic and inorganic soil removal properties as compositions of this invention.

Percentages and ratios are by weight unless otherwise indicated and temperatures unless noted otherwise are centigrade.

SUMMARY OF THE INVENTION

A general purpose household cleaning composition comprising in percentage by weight, calculated on the finished product:

(A) from about 3% to about 30% of a water-soluble, organic anionic, surface-active, detersive sulfuric acid reaction product, selected from the group consisting of paraffin sulfonic acid having from 12 to 22 carbon atoms; alkyl benzene sulfonic acid having from 8 to 18 carbon atoms in the alkyl radical; alkyl sulfuric acid ester, having from 10 to 22 carbon atoms in the alkyl group and having as a cation an alkali-metal, ammonium and substituted ammonium; and mixtures thereof;

(B) from about 2% to about 20% of a lower polypeptide having a molecular weight below 600, and an isoelectric point of at least 5.5, or mixtures thereof, or a protein hydrolysate containing at least 50% by weight, calculated on the hydrolysate, of lower polypeptides having a molecular weight below 600, and an isoelectric point of at least 5.5, containing at most 15% by weight of amino acids and at most 25% by weight of penta- and higher polypeptides; and (C) the balance a neutral carrier;

whereby the weight ratio of (A)/(B) is between about 6/1 to about 1/1.

DETAILED DESCRIPTION OF THE INVENTION

A preferred general purpose household cleaning composition of the present invention, particularly suitable for hard surfaces, contains in percentage by weight, calculated on the finished product:

(A) from about 3% to about 15%, preferably from about 6% to about 10%, of an organic, anionic, surface-active, detersive sulfuric acid reaction product, selected from the group consisting of paraffin sulfonic acid having from 12 to 22, preferably from 14 to 18 carbon atoms; linear alkyl benzene sulfonic acid having from 12 to 18 carbon atoms in the alkyl radical; fatty alcohol sulfuric acid ester having from 10 to 22, preferably from 12 to 18 carbon atoms in the fatty alcohol group; the corresponding sodium, potassium and ammonium salts; and mixtures thereof; and (B) from about 2% to about 10%, preferably from about 4% to about 8% of a di-, tri- or tetrapeptide having a molecular weight below 600, preferably between 350 and 450, and an isoelectric point of at least 5.5, and mixtures thereof, having a molecular weight below 600, preferably between 350 and 450, and an isoelectric point of at least 5.5, and containing at most 15% by weight of organic amino acids and at most 25% by weight of penta- and higher polypeptides;

(C) balance: water;

whereby the weight ratio of components (A)/(B) is between about 6/1 to about 1/1, preferably between about 4/1 to about 3/2; and the pH of the liquid composition varies between about pH 7 and pH 11.

Most preferred, because yielding an exceptional valuable combination of properties is a liquid, aqueous, homogeneous, clear, stable, general purpose household cleaning composition according to this invention, consisting of, in percentage by weight, calculated on the finished product:

(A) from about 6% to about 10% of a fatty alcohol sulfuric acid ester having from 12 to 18 carbon atoms in the fatty alcohol group, or the corresponding sodium, potassium or ammonium salt;

(B) from about 4% to about 8% of a di-, tri- or tetrapeptide, having a molecular weight between 350 and 450 and an isoelectric point above 5.5; and mixtures thereof; or a protein hydrolysate containing at least 75% by weight, calculated on the hydrolysate, of di-, tri- or tetrapeptides or mixtures thereof, having a molecular weight between 350 and 450, at most about 10% by weight of organic amino acids and at most 15% by weight of penta- and higher polypeptides;

(C) from about 0.5% to about 5%, preferably from about 1% to about 3% of a polyethenoxy nonionic surface-active detergent, preferably a condensation product of one mol of a $C_{8-18}$ alkanol with 6 to 25 moles of ethylene oxide, whereby the alkanol is preferably a secondary alkanol; and (D) balance: water;

whereby the weight ratio of components (A)/(B) is between about 4/1 to about 3/2; and the pH of the liquid composition varies between about pH 8 and pH 10.

The pH of the liquid composition of the present invention varies preferably between about pH 7 and about pH 11, most preferably between pH 8 and pH 10. The pH of the solution of the solid compositions should preferably be alkaline, showing a pH between about 7 and 11, most preferably between 8 and 10. If necessary, said pH can be obtained by adding small amounts of alkaline material as, for example, sodium and potassium hydroxide or alkaline builder salts.

It has also been found that the cleaning performance of said general purpose household cleaning composition of the present invention cannot only be appreciably optimized by adding a nonionic surface-active detergent, preferably an ethoxylated compound; but also by the incorporation of small amounts of solvents as ethanol, isopropanol, butanol; hydrotropes as benzene-, toluene-, xylene-, and cumene sulfonic acid and the corresponding potassium, sodium and ammonium salts; small amounts of urea but only in concentrated or diluted compositions having a pH below 9; further, mono- and dialkyl ethers of ethylene glycol and the derivatives thereof; minor amounts of an organic buffering agent as a triethanol and/or monoethanol amine; chlorine-releasing agents; abrasives; enzymes; dyes; and perfumes.

Suitable lower polypeptides and protein hydrolysates that can be used in formulating compositions according to the present invention are:

(a) di-, tri- and tetrapeptides of arginine, cystine, glycine, hystidine, hydroxyproline, isoleucine, leucine, lycine, methinine, phenylalanine, proline, serine, tryptophan, tyrosine, valine, and the ring-structured hydroxyproline and tryptophan. They can be synthesized, e.g. as disclosed in "Organic Chemistry" by Fieser & Fieser, page 431, etc. (Reinhold Publishing Corp., N.Y., 1956, 3rd Edition). They are, however, preferably derived from proteins as fibroin, keratin, collagen or its derivative: gelatin, prolamines, protamines, glutclins and casein. Preferred lower polypeptides are those from alpha-amino acids having from 2 to 6 carbon atoms, and having an isoelectric point of at least 6. The lower polypeptides of proline and leucine being insoluble in cold water, they are preferably used in combination with other soluble lower polypeptides in aqueous solutions of water and lower aliphatic alcohols as ethanol, isopropanol and butanol, and most preferably in such solutions having a pH at least one pH unit above their isoelectric point:

(b) protein hydrolysate or the hydrolysis product of substantially hydrolyzed fibrous proteins, as fibroin, collagen and its derivative: gelatin, keratin and clastin; globular proteins as albumin, casein and glutenin, prolamine and protamine, having an isoelectric point of at least 5.5, and a molecular weight below 600, preferably between about 350 and 450. More preferred are water-soluble lower polypeptides obtained from substantially hydrolyzed proteins as salmin (protamine), fibroin, collagen or gelatin, and casein, having a molecular weight between 350 and 450, and an isoelectric point of at least 5.5, most preferably above 6.5.

Proteins containing amino acids as fundamental structural units are very large molecules with molecular weights between 12,000 and several million. They are extremely sensitive and easily denatured. They can be hydrolyzed by aqueous solutions of mineral acids at the boiling point (e.g. by refluxing with about 20% hydrochloric acid or 35% sulfuric acid at 95°-100° C.) and enzymatically by proteases. Thermal acidic hydrolysis (i.e., with mineral acids at high temperatures) is fast and rather complete, the enzymatic hydrolysis is slow and mostly incomplete. The hydrolysate consists of pure amino acids and di-, tri- and higher polypeptides, whereby the obtained amounts of amino acids, of lower and of higher polypeptides, and the molecular weight of the latter depend upon the process conditions as pH, duration, temperature, concentration and species of enzyme, respectively. The amino acids and lower polypeptides can be removed from the higher polypeptides if necessary by dialysis, while the amino acids can be removed from the lower polypeptides, e.g. by centrifugation.

Typical lower polypeptides of hydrolyzed proteins by enzymes are obtained by the action of peptidases on collagen, casein, prolamines, e.g. zein from corn, and protamines at 30° to 60° C. for 12 to 60 hours, or even longer if the amount of polypeptides and thus the average molecular weight of the amino acid mixture is still too high. The excess of polypeptides can also be removed, e.g. by dialysis, however. Preferred are lower polypeptides obtained by enzymatic hydrolysis of solubilized collagen digested with peptidases and a small amount of trypsin (proteinase) at 50°-55° C. during 48-60 hours. Hydrolysis with proteinases as pepsin and trypsin only is rather to be avoided because of the high amounts of penta-, hexa- and even higher polypeptides in the hydrolysate.

Of the lower polypeptides obtained by thermal-acidic hydrolysis, those obtained by prolonged heating in the presence of mineral acids are preferred because they mainly consist of di-, tri- and tetrapeptides and a relatively low amount of organic amino acids which can be removed, if necessary.

Typical lower polypeptides by thermal-acidic hydrolysis are obtained by heating of 10% to 40% by weight solutions or suspensions of proteins as salmin, fibroin, collagen, gelatin, glutelin, zein and keratin in water, at 80° to 100° C., for 4 to 7 hours, at a pH of about 2 to about 4, preferably at about pH 2.8. A reducing agent as sodium bisulfite is preferably added in minor amounts to improve the odor and color of the hydrolysate. The excess of amino acids is then removed by centrifugation.

In general, the lower peptides obtained by either enzymatic- or thermal-acidic hydrolysis can be recuperated or removed from the hydrolysate by precipitation or centrifugation, or the hydrolysate can be concentrated by vacuum, while the polypeptides with the desired isoelectric point can be isolated, for example with ion-exchange resins at the desired pH.

Since amino acids and peptides, consisting of amino acids, contain both carboxyl and amino groups, they ionize both as acids and base. For each specific amino acid or polypeptide, there is a given pH at which said basic and acidic ionization is equal, also known as the isoelectric point of the amino acid or polypeptide.

Most proteins contain about 20 different amino acids. The total amino acid content of most proteins, as well as the content of each specific amino acid, is well known (see for example "Organic Chemistry" by Fieser & Fieser, page 430, 3rd Edition, 1956; Reinhold Publishing Corp., New York, N.Y.). To obtain polypeptides having an average isoelectric point of at least 5.5, one can easily select the right protein to obtain the desired polypeptides or remove some of the polypeptides with low isoelectric point from said mixture (e.g. those containing aspartic acid and glutamic acid, amino acids having two carboxyl groups). Since the solubility of most polypeptides (as well as of most amino acids) goes through a minimum at their isoelectric point, lowering the pH of the solution to pH 5.5 or lower and adding an organic solvent as ethanol may precipitate the polypeptides with an isoelectric point of 5.5 or below. Preferred are mixtures of lower polypeptides obtained from selected proteins as salmin, fibroin, gelatin, collagen and casein by thermal-acidic hydrolysis.

Organic, anionic, surface-active, detersive sulfuric acid reaction products to be used in formulating compositions according to the present invention are:

(a) paraffin sulfonic acid having from about 12 to about 22 carbon atoms, preferably from about 14 to about 18 carbon atoms, and the corresponding sodium-, potassium-, ammonium-, and methyl-, ethyl- or hydroxyethyl- substituted ammonium salts, and mixtures thereof. Said paraffin sulfonic acids can be prepared, for example, from n-paraffins derived from straight-run distillates of petroleum or paraffin-base crude oil, reacted with a sulfonating agent, e.g. $SO_3$, $H_2SO_4$, oleum according to known sulfonation processes, as described for example in the British Patent Specification No. 1,111,208, and optionally bleached, hydrolyzed and neutralized. Most preferred are secondary paraffin sulfonates. Specific examples are $C_{14}H_{29}SO_3Na$; $C_{16}H_{33}SO_3NH_4$; $C_{12}H_{25}SO_3K$; $C_{16}H_{33}SO_3NH(CH_2CH_2OH)_2$; $C_{18}H_{37}SO_3NH_4$; $C_{22}H_{45}SO_3NH_4$;

(b) alkylbenzene sulfonic acid, preferably linear alkylbenzene sulfonic acid, having from 8 to 18 carbon atoms in the alkyl radical, and the corresponding sodium-, potassium-, ammonium- and substituted ammonium salts, and mixtures thereof. Alkylbenzene sulfonic acids and salts as dodecyl-, tetradecyl- and hexadecylbenzene sulfonic acid can be prepared by reacting the corresponding alkylbenzene compounds with a sulfonating agent as disclosed, for example, in the U.S. Pat. Nos. 2,220,099 and 2,477,383;

(c) alkyl sulfuric acid ester, preferably fatty alcohol sulfuric acid ester having from 10 to 22, preferably from 12 to 18 carbon atoms, and the corresponding sodium-, potassium- and ammonium salts, obtained by sulfating hydroxylated hydrocarbons, preferably fatty alcohols having 10 to 22, preferably 12 to 18 carbon atoms, most preferably coconut fatty alcohol having mainly 12 to 14 carbon atoms, with $SO_3$, $H_2SO_4$, etc., according to known processes, followed by hydrolysis and/or bleaching, and neutralized. The alkyl sulfuric acid esters are also known as alkyl sulfates.

The amounts of lower polypeptides and/or of protein hydrolysate, as defined hereinbefore, to be used in the composition of this invention can vary from about 2% to about 20%, 2–10% preferably from about 4% to about 8% by weight, calculated on the total composition, depending upon the physical form of the composition, e.g. powdered or liquid. The most important parameter to obtain an effective general purpose household cleaning composition is, however, the weight ratio of the lower polypeptides and/or protein hydrolysate (B) versus the specific, water-soluble, organic, surface-active, detersive anionic sulfuric acid reaction product (A). Said weight ratio (A)/(B) should be between about 6/1 and about 1/1, preferably between about 4/1 and about 3/2. Compositions beyond said ratios hardly show any additional cleaning benefit. In case the finished product is in a dry form, e.g. powder, agglomerate, it may contain up to 20% of lower polypeptides and/or protein hydrolysate, and the weight ratio detergent (A) to polypeptide and/or protein hydrolysate may be as high as 6/1 and as low as 1/1. In case of liquid compositions, which can be used as such or diluted in water, weight ratios of about 4/1 to about 3/2 are preferred.

Another important parameter is the isoelectric point of the lower polypeptides or protein hydrolysate. Lower polypeptides or protein hydrolysates having an isoelectric point below 5.5 are not as effective as those whith an isoelectric point above 5.5, especially in hard water, e.g. containing about 1 millimole of $CaCO_3$/liter. However, the higher the isoelectric point of the lower polypeptide or protein hydrolysate, the lower the amount of polypeptide and/or protein hydrolysate needed. Therefore, the weight ratio of specific sulfuric acid reaction product (A) to lower polypeptides and/or protein hydrolysates having an isoelectric point of at least 6.5 (B) is preferably between about 6/1 and about 3/2, but in liquid compositions because of formulation reasons, most preferably about 4/1 to 3/2.

From this, it follows that the amount of specific, water-soluble, organic, surface-active, detersive sulfuric acid reaction product in the composition of this invention is bound to the amount of lower polypeptides and/or protein hydrolysate present. In general, the amount of said specific sulfuric reaction product should be at least about 3% by weight to have a minimum detergency effect and can but should preferably not exceed the 30% by weight, and is most preferably between 3% and about 15% by weight in dry compositions and between about 6% and about 10% by weight in liquid compositions.

The minimum amount of both specific sulfuric acid reaction product and lower polypeptides and/or protein hydrolysate in the composition of this invention should be at least about 5% by weight, preferably about 8% by weight, to yield the desired cleaning effect when used at normal usage concentration, e.g. about 1% by weight of the finished product diluted in hard water. The maximum amount of essential components is only restricted by formulation requirements and can be as high as 50% by weight of the total composition, and even higher if anhydrous salts are used as neutral carrier, and is in liquid compositions preferably restricted to 25% by weight for stability and esthetical reasons. Preferred are liquid compositions containing about 10% to about 18% by weight of essential components.

The carrier, desirable for easy formulation of the final composition, should be neutral, i.e., should not react with any of the components and be feasible. Preferred neutral carriers in dry solid compositions are: sodium sulfate, sodium carbonate, neutral clays, small amounts of silicates, if desired some abrasives, as pumice, and mixtures thereof. The neutral carrier in liquid compositions is water or water and small amounts of organic solvents as ethanol, isopropanol, etc, as described hereinafter.

Other compounds which can be added to the composition of the present invention are:

Polyethenoxy nonionic surface-active detergents. They are preferably added in amounts up to 15% by weight, and most preferably into liquid compositions, in amounts up to 8% by weight. Specific examples of polyethenoxy nonionic surface-active detergents are: condensate of, in average 6 to 25 moles of ethylene oxide, preferably 9 to 15 moles of ethylene oxide with one mole of an aliphatic mono-alcohol, preferably a secondary alcohol, having from about 8 to about 18 preferably from 12 to 18 carbon atoms. Specific examples of suitable compounds are:

$C_{12}H_{25}O(C_2H_4O)_{12}H$; $C_{14}H_{29}O(C_2H_4O)_{15}H$; $C_{12}H_{25}O(C_2H_4O)_9H$.

Solvents. The water-soluble $C_{2-8}$ aliphatic mono-, di-, and tri-alcohols. Specific examples are ethanol, tert-butanol, iso-butanol, propanol, iso-propanol, iso-amyl alcohol, tert-amyl alcohol, hexanol, 2-ethyl hexane-1,3-diol, cyclohexanol, propane-1,3-diol, hexane-1,6-diol. Other suitable solvents are the phenyl alkylols having 1 to 3 carbon atoms in the alkylol group, as for example, phenylethyl alcohol, phenylpropyl alcohol and carbitol. Other suitable solvents are ethylene-, propylene-, diethylene- and dipropylene glycol and the mono- and di-$C_{1-4}$ alkyl ether derivatives thereof as the ethylene glycol monomethyl-, monoethyl- and monobutyl ethers; propylene glycol propyl ether and dipropylene glycol methyl ether.

Although some of said solvents can be added in small amounts into solid composition to help solubilize some lower polypeptides when the composition is diluted in water, their use is preferably restricted to liquid compositions, and the amounts limited to 10%, preferably to 6% by weight calculated on the total weight of the finished liquid composition.

Hydrotropes. Sodium-, potassium- and ammonium xylene-, toluene, ethyl-benzene- and isopropylbenzene sulfonates can be added into liquid composition of the present invention in amounts up to 10% by weight, preferably up to about 4% by weight, particularly in compositions containing mixtures of the specific sulfuric acid reaction products.

The composition of the present invention can also contain minor amounts, e.g. up to 2% of one or more of the usual additives as, for example, perfume, dyes, bactericides, opacifiers and ammonia.

Organic and inorganic builder salts. If present, their concentration should be restricted because they do not enhance the cleaning action of the composition of this invention, create formulation difficulties in liquid compositions and negatively influence the shine benefit. Beneficial to adjust the pH of the composition, they can be present in amounts up to about 8% in solid and up to about 5% in liquid compositions.

The following tests and examples illustrate the invention:

TEST I (Grease and inorganic soil removal test)

Three (3) polyvinylchloride strips of 70 × 9 × 0.3 cm are each soiled with 15 g of a mixture of grease and particulate soil (weight ratio: grease/soil = 6/4, grease = cooking fat, soil = sieved vacuum cleaner soil collected in (households). The mixture of grease and soil is spread evenly over the strips. The soiled strips are then set apart for 48 hours.

Seven (7) different washing liquors are prepared, each containing 1.5% by weight of one of the compositions A-G, defined hereinafter, with tap water of a hardness equivalent of 2.7 mMoles Ca.

Twenty (20) grams of each washing liquor is poured onto a different synthetic commercial sponge (dry, about 8.5 × 7.5 × 3 cm, weight about 10 g).

The first polyvinylchloride strip is fixed in horizontal position. The sponge containing 20 grams of washing liquor prepared with composition A is mechanically moved forward and backwards over said strip in the direction perpendicular to the length of said strip, at a uniform pressure (about 10 g/cm$^2$). In total, five strokes forward and five strokes backwards are applied, cleaning a path of about 7.5 cm on said strip.

The same cleaning method is repeated with the sponge containing 20 g of washing liquor prepared with composition B, on the same strip, but cleaning a path next to the path cleaned with the sponge containing a solution of composition A, all other circumstances being identical.

The same cleaning method is repeated subsequently with the sponges containing solutions of compositions C,D,E,F, and G respectively yielding seven paths of about 7.5 cm width, next to each other cleaned with said different solutions.

The same cleaning method is then repeated with the second and third strip.

The cleaning performance is judged visually by three independent graders, judging each strip individually and classifying the seven cleaned paths on each strip from 1 to 7, with the best cleaned path ranked first and the worst seventh (and equally cleaned paths got the same ranking).

The cleaning compositions tested consist of (figures in & by weight):

| | A | B | C | D | E | F | G |
|---|---|---|---|---|---|---|---|
| $C_{12}$-$C_{14}$ alkyl dimethyl amine oxide | — | — | — | — | — | 1.5 | — |
| Coconut alkyl-$SO_4Na$ | 7 | 7 | 7 | 7 | 9 | — | — |
| Coconut alkyl-$(OC_2H_4)_6OSO_3Na$ | — | — | — | — | — | — | 9 |
| Paraffin-$SO_3Na$ | 2 | 2 | 2 | 2 | 4 | — | — |
| $C_{15}$ alkyl-$(OC_2H_4)_9OH$ | 3 | 3 | 3 | 3 | 5 | — | — |
| Protein hydrolysate (derived from gelatin, average mol. weight 400) | 6 | — | — | — | — | — | 6 |
| Protein hydrolysate (derived from gelatin, average mo. weight 800) | — | 6 | — | — | — | — | — |
| Glycine | — | — | 6 | — | — | — | — |
| Tetrapotassium pyrophosphate | — | — | — | 6 | — | 20 | — |
| Potassium toluene sulfonate | — | — | — | — | — | 3.5 | — |
| Water | | | | Balance | | | |

The cleaning performances were ranked as follows:

| | 1st Grader | | | | | | |
|---|---|---|---|---|---|---|---|
| | A | B | C | D | E | F | G |
| 1 | 1 | 5 | 7 | 3 | 4 | 2 | 6 |
| 2 | 1 | 6 | 7 | 3 | 4 | 2 | 5 |
| 3 | 1 | 6 | 7 | 3 | 5 | 2 | 4 |
| | 2nd Grader | | | | | | |
| | A | B | C | D | E | F | G |
| 1 | 1 | 6 | 7 | 3 | 4 | 1 | 4 |
| 2 | 1 | 7 | 6 | 2 | 5 | 2 | 4 |
| 3 | 1 | 6 | 7 | 2 | 4 | 3 | 4 |
| | 3rd Grader | | | | | | |
| | A | B | C | D | E | F | G |
| 1 | 1 | 7 | 6 | 4 | 3 | 2 | 5 |
| 2 | 2 | 4 | 7 | 3 | 5 | 1 | 6 |
| 3 | 1 | 7 | 6 | 3 | 4 | 2 | 5 |

Thus, composition A, containing the protein hydrolysate as specified in this invention is superior to all other compositions, including those containing an equal amount of protein hydrolysate not fulfilling the necessary requirements or an equal amount of amino acid or a conventional builder salt. The composition A is also superior to a composition containing an equal amount by weight containing surfactants (E) but no protein hydrolysate or to a conventional household cleaner as sold in the market today (F) containing 20% by weight of phosphates. Also it is seen that addition of the protein hydrolysate fulfilling the requirements of this invention to ethoxylated sulfates (G) does not lift the cleaning performance.

When repeating the above-described cleaning method with the same solutions, but on one strip of stainless steel of 7 × 10 × 0.15 cm, the same performance trend is observed with composition A yielding even more pronounced results.

Repeating the same cleaning method but with solutions containing only compositions A, B and C respectively, on three individual glazed tiles (10 × 10 × 0.8 cm), the cleaning performance of solutions containing composition A is again superior to the cleaning obtained with solutions containing composition B and C respectively.

TEST II

The superiority of the compositions, according to the claims of the present invention, in streaking/filming performance is shown by the following tests:

Twelve black, glazed tiles (10 × 10 × 0.8 cm) are carefully washed with a commercial household cleaner product to remove all possible residues (greases, dust, etc.) from the surface, repeatedly rinsed under running water and wipe-dried with a clean terry towel.

By means of this pre-treatment, the same surface characteristics are imparted to all the tiles.

The tiles are split into 3 groups (I, II, III) of 4 tiles each, treated with washing liquor containing 1.1% by weight of compositions A, D and F as specified above, and found to be the best cleaning compositions but of the series of 7. Exactly the same cleaning method as in Test I is used.

The hardness of the water to prepare the washing liquor is expressed in millimoles of $CaCO_3$ per liter: 2.7. Product A is applied to series I, D to II and F to series III.

After the five strokes are applied, the sponge and carriage are removed and the test tile left to dry.

Once dry, the tiles of I ($I_1$, $I_2$, $I_3$, $I_4$) are compared with the tiles of group II ($II_1$, $II_2$, $II_3$, $II_4$) and III ($III_1$, $III_2$, $III_3$, $III_4$) respectively, with respect to filming/streaking, under standard northern daylight, independently by two experienced graders applying the following standards:

0 = no difference; +1 = directionally superior; −1 = directionally inferior in streaking/filming; +2 = superior; −2 = inferior in streaking/filming; +3 = clearly superior; −3 = clearly inferior in streaking/filming.

The preferences expressed by these graders are as follows:

| | $I_1$ vs $II_1$ | $I_2$ vs $II_2$ | $I_3$ vs $II_3$ | $I_4$ vs $II_4$ |
|---|---|---|---|---|
| Grader 1 | +2 | +2 | +2 | +2 |
| Grader 2 | +3 | +2 | +3 | +2 |

-continued

| | $I_1$ vs $III_1$ | $I_2$ vs $III_2$ | $I_3$ vs $III_3$ | $I_4$ vs $III_4$ |
|---|---|---|---|---|
| Grader 1 | +3 | +3 | +3 | +3 |
| Grader 2 | +3 | +3 | +3 | +3 |

Thus, composition A is superior in streaking/filming to a commercial household cleaner composition F but also to composition similar to A where the hydrolysate was replaced by an equal amount of builder.

EXAMPLES

The following examples further illustrate the scope of the present invention:

| | 1 | 2 | 3 | 4 | 5 | 6 |
|---|---|---|---|---|---|---|
| Paraffin-$SO_3Na$ | — | — | 6 | — | — | — |
| Coconut-alkyl-$SO_4Na$ | 9 | 6 | — | 9 | 9 | 9 |
| Linear $C_{12}$ alkyl benezene-$SO_3Na$ | — | 2 | 3 | — | — | — |
| Protein hydrolysate* | 8 | 5 | 6 | 5 | 5 | 5 |
| $C_{15}$ alkyl $(OC_2H_4)_9OH$ | — | 2 | 3 | 2 | 2 | 2 |
| Sodium tripolyphosphate | — | — | — | 1 | — | — |
| Boric acid | — | — | — | — | — | 2 |

*Protein hydrolysate is the thermal-acidic hydrolysis product of a commercial gelatin, having an average molecular weight of 400. If this hydrolysate is for example replaced by the hydrolysis product of soy bean protein, in the same molecular weight range between 350–450, the same effect on cleaning and streaking film is obtained.

As shown in examples 4, 5 and 6, other ingredients can be added that do not affect the main performance areas of diluted cleaning and streaking or filming reduction.

What is claimed is:

1. A general purpose household cleaning composition comprising in percentage by weight, calculated on the finished product:

(A) from about 3% to about 30% of a water-soluble, organic, anionic, surface-active, detersive sulfuric acid reaction product, selected from the group consisting of paraffin sulfonic acid having from 12 to 22 carbon atoms; alkyl benzene sulfonic acid having from 8 to 18 carbon atoms in the alkyl radical; alkyl sulfuric acid ester, having from 10 to 22 carbon atoms in the alkyl group and having as a cation an alkali-metal, ammonium and substituted ammonium; and mixtures thereof;

(B) from about 2% to about 20% of a lower polypeptide having a molecular weight below 600, and an isoelectric point of at least 5.5, or mixtures thereof, or a protein hydrolysate containing at least 50% by weight, calculated on the hydrolysate, of lower polypeptides having a molecular weight below 600, and an isoelectric point of at least 5.5, containing at most 15% by weight of amino acids and at most 25% by weight of penta- and higher polypeptides; and (C) the balance a neutral carrier; whereby the weight ratio of (A)/(B) is between about 6/1 to about 1/1.

2. The general purpose household cleaning composition according to claim 1 comprising:

(A) from about 3% to about 15%, by weight of an organic, anionic, surface-active detersive sulfuric acid reaction product, selected from the group consisting of secondary paraffin sulfonic acid having from 14 to 18 carbon atoms; linear alkylbenzene sulfonic acid, having from 12 to 18 carbon atoms in the alkyl radical; fatty alcohol sulfuric acid ester, having from 12 to 18 carbon atoms in the fatty alcohol group; and having as a cation sodium, potassium and ammonium; and mixtures thereof;

(B) from about 2% to about 10%, by weight of a di-, tri- or tetrapeptide, having a molecular weight below 600, and an isoelectric point of at least 5.5, and mixtures thereof, or a protein hydrolysate containing at least 50% by weight, calculated on the hydrolysate, of di-, tri- or tetrapeptides or mixtures thereof, having a molecular weight below 600, and an isoelectric point of at least 5.5, and containing at most 15% by weight of organic amino acids and at most 25% by weight of penta- and higher polypeptides; and (C) the balance water; whereby the weight ratio of components (A)/(B) is between about 6/1 and about 1/1, and the pH of the liquid composition varies between about pH 7 and about pH 11.

3. The general purpose household cleaning composition according to claim 1 wherein the specific sulfuric acid reaction product is a fatty alcohol sulfuric acid ester having from 12 to 18 carbon atoms in the fatty alcohol group.

4. The general purpose household cleaning composition according to claim 1 wherein the lower polypeptide is a di-, tri- or tetrapeptide having a molecular weight between 350 and 450 and an isoelectric point of at least 6.5, or mixtures of said lower polypeptides.

5. The general purpose household cleaning composition according to claim 1 wherein the protein hydrolysate contains at least 75% by weight of di-, tri- or tetrapeptides, and mixtures thereof, having a molecular weight between 350 and 450, at most 10% by weight of organic amino acids and at most 15% by weight of penta- and higher polypeptides.

6. The general purpose household cleaning composition according to claim 1 additionally comprising from about 0.5 to about 5% by weight of a polyethenoxy nonionic surface-active detergent.

7. The general purpose household cleaning composition according to claim 1 wherein the weight ratio of specific sulfuric acid reaction product to lower polypeptide or protein hydrolysate is between about 4/1 and about 3/2, and having an isoelectric point of at least 6.5.

* * * * *